United States Patent [19]

Golay

[11] Patent Number: 4,741,270

[45] Date of Patent: May 3, 1988

[54] FUSE FOR PROJECTILE

[75] Inventor: Jean-Pierre Golay, Viry, France

[73] Assignee: Mefina S.A., Fribourg, Switzerland

[21] Appl. No.: 41,073

[22] PCT Filed: Jun. 13, 1986

[86] PCT No.: PCT/CH86/00087

§ 371 Date: Mar. 12, 1987

§ 102(e) Date: Mar. 12, 1987

[87] PCT Pub. No.: WO87/00615

PCT Pub. Date: Jan. 29, 1987

[30] Foreign Application Priority Data

Jul. 12, 1985 [CH] Switzerland ..... 3025/85

[51] Int. Cl.[4] ..... F42C 9/14; F42C 15/24

[52] U.S. Cl. ..... 102/271; 102/251

[58] Field of Search ..... 102/271, 272, 251, 255, 102/256, 248, 249

[56] References Cited

U.S. PATENT DOCUMENTS

| | | | |
|---|---|---|---|
| 1,751,616 | 3/1930 | Brayton | 102/226 |
| 1,933,608 | 11/1933 | Teitscheid | 102/271 |
| 2,524,060 | 10/1950 | Liljegren | 102/226 |
| 3,352,241 | 11/1967 | Combourieux | 102/271 X |
| 3,715,987 | 2/1973 | Morel et al. | 102/271 X |
| 4,230,042 | 10/1980 | Popovitch | 102/270 X |
| 4,389,937 | 6/1983 | Goloy et al. | 102/251 X |
| 4,606,271 | 8/1986 | Goloy et al. | 102/271 X |

FOREIGN PATENT DOCUMENTS

| | | | |
|---|---|---|---|
| 2242956 | 3/1973 | Fed. Rep. of Germany | 102/271 |
| 1204450 | 1/1960 | France . | |
| 348631 | 10/1960 | Switzerland . | |
| 27609 | of 1904 | United Kingdom | 102/271 |

*Primary Examiner*—David H. Brown

*Attorney, Agent, or Firm*—Gifford, Groh, VanOphem, Sheridan, Sprinkle and Dolgorukov

[57] ABSTRACT

A fuse comprises a firing pin provided with a tip eccentric with respect to the longitudinal axis of the firing pin. By turning the firing pin by means of a cap in which it is mounted, the tip can be placed to face one or the other of two firing caps having different firing characteristics.

3 Claims, 2 Drawing Sheets

FUSE FOR PROJECTILE

BACKGROUND OF THE INVENTION

The present invention relates to a fuse for projectiles comprising a body having a rotor carrying two firing caps, each of the firing caps having different characteristics, and cooperating with a detonator in the form of a firing pin carried by a cap covering the body, with the firing pin being displaced axially during impact of the projectile in order to strike a firing cap.

A fuse of this general type has been known. Such a fuse has been described in the French Pat. No. 1 204 450. In this known fuse, the firing caps are placed in a median plane of the fuse, but are offset angularly on the rotor. The present invention aims at obtaining the same advantages of operation but with a simpler construction and a construction which is more reliable and less expensive.

SUMMARY OF THE INVENTION

The present invention is characterized in that the two firing caps are mounted side by side, means have been provided in order to allow, at will, the firing pin to cooperate with one or the other of the firing caps; and the rotor always makes the same angular displacement in order to bring the firing caps to the active position.

BRIEF DESCRIPTION OF THE DRAWING

The attached drawings represent schematically and for sake of example, a form of execution of the fuse being the object of the invention. In the drawings.

DETAILED DESCRIPTION OF A PREFERRED EMBODIMENT OF THE INVENTION

The fuse of the present invention comprises a body 1 in which is mounted a cap 2 which can be displaced angularly with respect to the body 1. The given position of cap 2 is maintained by the friction exercised by a ring 3, on the body 1 and which is an integral part of the cap 2, and which is provided with two ring joints 4 and 5.

Figure 1:
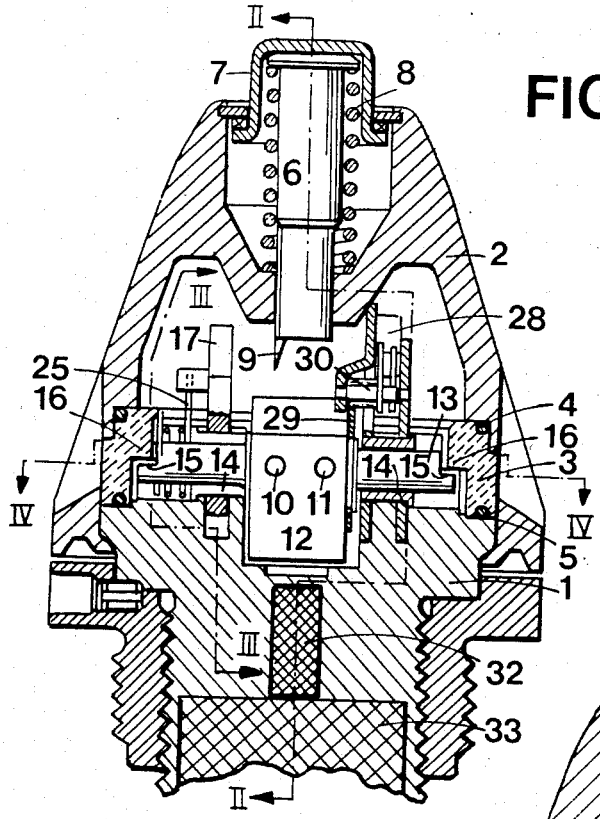
FIG. 1 is an axial section of the fuse of the present invention.

The upper part of the cap 2 carries a firing pin 6 urged against a caplet 7 by a spring 8. The firing pin 6 is provided with a tip 9 which is eccentrically located with respect to the longitudinal axis of the fuse. The firing pin 6 is designed to cooperate with one or the other of the firing caps 10 and 11 which are carried by a rotor 12, the latter being shown at FIG. 1 in the safety position in which the two firing caps 10 and 11 are placed outside the trajectory of the tip 9 of the firing pin 6. The rotor 12 is an integral part of a shaft 13 and rotates in bearings 14 carried by the body 1. The ends of the shaft 13 each have a flat part 15 located in front of a flange 16 of the ring 3 when the ring 3 is in the safety position as produced by the angular position of the cap 2.

Figure 3:
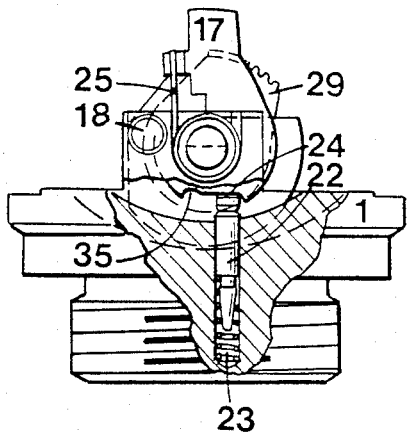
FIG. 3 is a partial section through line III—III of FIG. 1.
Figure 4:
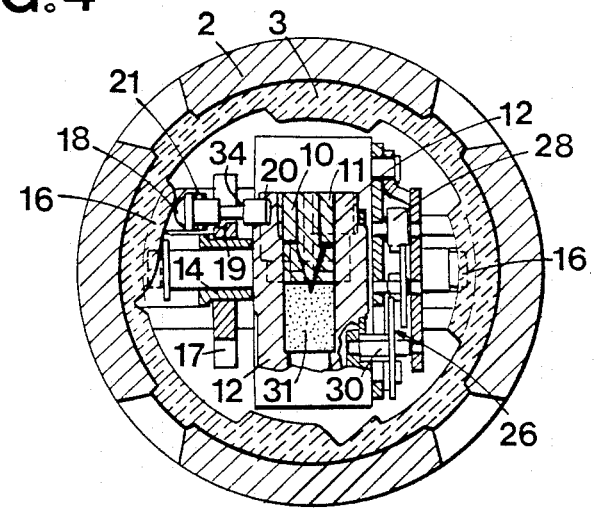
FIG. 4 is a section through line IV—IV of FIG. 1.

The angular displacement of the rotor 12 brings the firing caps 10 and 11 into operating position and is controlled by a device which is shown in FIGS. 3 and 4. This device is comprised of an inertial lever 17 pivotally mounted on one of the bearings 14. The inertial lever 17 has its center of gravity eccentric to the axis of the bearing 14 and is retained in its safety position shown in FIGS. 3 and 4 by a lock 18 engaged in a slot 19 of the lever 17, as well as in another slot 20 of the rotor 12. The lock 18 is urged in a direction outward of the projectile by a spring 21, but it is retained in its position by one of the flanges 16 of ring 3, when the latter is in the safety position. Furthermore, the lever 17 is engaged by a finger 22, which, in turn, is turn, is urged by a spring 23, against a stop 24 of the lever 17.

Figure 2:
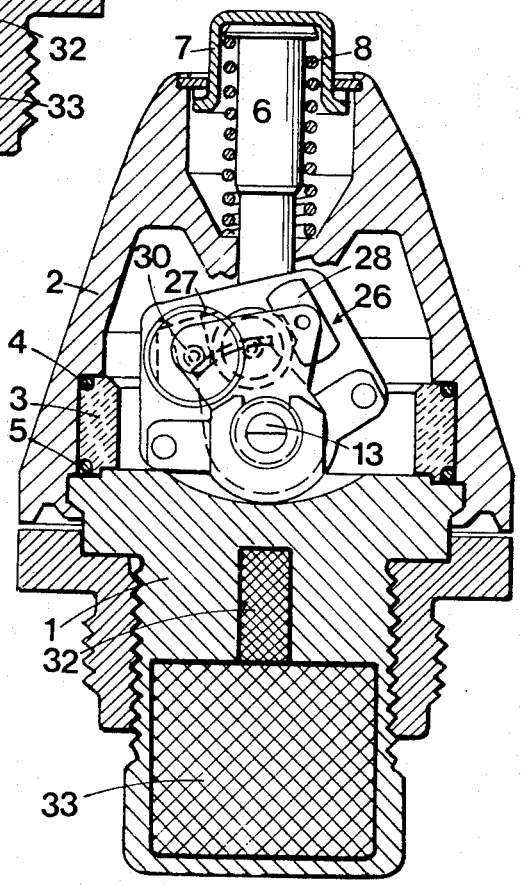
FIG. 2 is a partial section through line II—II of FIG. 1.

A torsion spring 25, wound on the shaft 13 of the rotor 12, is attached at one end to the lever 17 and at the other end to the shaft 13. The spring 25 is designed to supply the driving couple for turning the rotor 12 after the shot has been fired and to bring it into the active position, allowing the tip 9 of the firing pin 6 to strike one or the other of the firing caps 10 or 11. The rotation of the rotor 12 is timing by an escapement mechanism 26. As shown at FIG. 2, this mechanism includes a gear multiplier 27 operating together with a balance 28. The start of the mechanism 26 is made by a toothed sector 29 which is an integral part of the rotor 12 and which meshes with a toothed pinion 30 of that mechanism.

As shown at FIG. 4, the two firing caps 10 and 11 fire a pyrotechnical reinforcement relay 31, which, in the armed position of the fuse, is placed facing a pyrotechnical transmission relay 32 (FIG. 1) which is designed to ignite a detonator or booster 33. The two firing caps 10 and 11 have different firing characteristics, the firing cap 10, for instance, being designed to fire instantaneously whereas the firing cap 11 is designed to retard the ignition, the retardation being generally not more than a fraction of a second after impact.

The operation of the fuse is as follows:

Before arming the weapon with a projectile, the cap 2 must be positioned so that the fuse is removed from the safety position employed during transportation by disengaging the flange 16 from the flat parts 15, the cap 2 being turned in one of two positions in order to bring the tip 9 of the firing pin 6 against one of the firing caps 10 and 11 which corresponds to the desired operation.

During this initial rotation of the cap 2, the flange 16 of the ring 3 frees the lock 18 so that it executes a first part of its run to free the inertial lever 17 by disengaging from the slot 19.

Because of the bearing 34 of the lock 18, this displacement is limited by abutment of that bearing 34 against lever 17 so that the end of the lock 18 stays in slot 20.

The acceleration acts upon the projectile as the fired shot displaces the pushing finger 22 (FIG. 3) against the action of the spring 23 in order to allow the lever 17 to turn by inertia in the clockwise direction, in reference to FIG. 3, to tighten the spring 25.

When the lever 17 makes approximately a quarter turn rotation, it disengages the lock 18 completely because of a notch 35 provided in the lever 17 and in which the lock 18 engages in order to lock lever 17 in its armed position. The rotor 12 is then unlocked and turns under the effect of the driving force of the spring 25, the displacement being timed by the timing mechanism 26. As soon as the rotor 12 makes an angular displacement of approximately a quarter turn, the duration of that displacement being provided to provide the safety of the weapon, one of the firing caps 10 or 11 finds itself facing the tip 9 of the firing pin 6, whereas the reinforcing relay 31 is placed in regard of the relay 32 and the booster 33.

I claim:

1. A fuse for a projectile comprising a body, a cap rotatably mounted relative to said body, said body carrying a rotor having two firing caps having different characteristics, said two firing caps cooperating with a detonator, a firing pin mounted for rotation with said cap, said firing pin being axially displaceable during impact of said projectile for striking one of said two firing caps, said two firing caps being mounted on said rotor, said two firing caps having parallel axis extending along a plane, said plane extending parallel to the axis of rotation of said rotor, said rotor rotating a predetermined angular displacement to an active position from a safety position to bring said two firing caps to the active position and means for allowing said firing pin to selectively cooperate with one of said two firing caps.

2. The fuse according to claim 1, wherein said firing pin has a tip eccentrically located with respect to the axis of said fuse such that rotation of said firing pin with respect to said body permits said tip to engage one of said two firing caps.

3. A fuse for a projectile comprising:

a body;

a cap rotatably mounted to said body;

a rotor rotatably mounted within said cap, said rotor rotatable a predetermined angular displacement between a safety position and an active position:

two firing caps mounted on said rotor, said two firing caps mounted a long parallel axes extending along a plane containing the axis of rotation of said rotor, said two firing caps having different firing characteristics, and a firing pin having a tip portion eccentrically positioned with respect to a longitudinal axis of said firing pin, said firing pin having means for fixing said firing pin for radial movement in response to rotation of said cap such that said tip of said firing pin is movable between a first position in axial alignment with one of said two firing pins and a second position in axial alignment with an other of said two firing pins when said cap is rotated, said firing pin axially movable with respect to said cap during impact of the projectile to engage one of said two firing pins when said rotor is in said active position.

* * * * *

UNITED STATES PATENT AND TRADEMARK OFFICE

CERTIFICATE OF CORRECTION

PATENT NO. : 4,741,270

DATED : May 3, 1988

INVENTOR(S) : Jean-Pierre Golay

It is certified that error appears in the above-identified patent and that said Letters Patent is hereby corrected as shown below:

Col. 2, line 9, delete "is turn".

Col. 4, line 7, delete "a long" and insert --along--.

Signed and Sealed this

Twentieth Day of September, 1988

*Attest:*

DONALD J. QUIGG

*Attesting Officer*

*Commissioner of Patents and Trademarks*